US006224438B1

(12) United States Patent
Hase

(10) Patent No.: US 6,224,438 B1
(45) Date of Patent: May 1, 2001

(54) STEERING SYSTEM FOR PLURAL MARINE PROPULSION ENGINES

(76) Inventor: Jeffrey W. Hase, 103 Ballman Ave. Box 25, Martin, ND (US) 58758

( * ) Notice: Subject to any disclaimer, the term of this patent is extended or adjusted under 35 U.S.C. 154(b) by 0 days.

(21) Appl. No.: 09/578,936

(22) Filed: May 25, 2000

(51) Int. Cl.[7] ..... B63H 5/125
(52) U.S. Cl. ..... 440/63; 114/144 R
(58) Field of Search ..... 114/144 R; 440/61, 440/62, 63, 53

(56) References Cited

U.S. PATENT DOCUMENTS

| | | | | |
|---|---|---|---|---|
| D. 32,822 | | 6/1900 | Morgan . | |
| 2,895,445 | | 7/1959 | Foraker . | |
| 2,899,833 | | 8/1959 | Prier . | |
| 3,756,186 | | 9/1973 | Nordling . | |
| 4,009,678 | | 3/1977 | North . | |
| 4,311,471 | | 1/1982 | Queen . | |
| 4,416,636 | * | 11/1983 | Boda | 440/63 |
| 4,573,930 | | 3/1986 | Queen . | |
| 4,808,131 | | 2/1989 | Glen . | |
| 4,836,812 | | 6/1989 | Griffiths . | |
| 4,919,629 | | 4/1990 | Isogawa et al. . | |
| 5,049,097 | * | 9/1991 | Rodskier et al. | 440/63 |
| 5,108,321 | | 4/1992 | Nelson . | |
| 5,154,651 | | 10/1992 | Binversie et al. . | |
| 5,997,370 | | 12/1999 | Fetchko et al. . | |

OTHER PUBLICATIONS

Advertising display banner for "Motor Link Steering Kit". Goldeneye Products, Inc. Minneapolis, MN. Date unknown.

* cited by examiner

*Primary Examiner*—Stephen Avila

(57) ABSTRACT

A steering system for plural marine propulsion engines for steering primary and secondary marine propulsion engines. The system includes a steering apparatus kit includes a tilt tube shaft adapted for slidably mounting in the secondary tilt tube of the secondary engine. A slave drag link is adapted for linking a second end of the tilt tube shaft to the secondary marine propulsion engine. A first end of the slave drag link is adapted for pivotally mounting on the tilt tube shaft. A second end of the slave drag link is adapted for pivotally mounting on the secondary marine propulsion engine. A pivot mount is adapted for mounting on the secondary tilt tube. A pivot link is adapted for pivotally mounting on the pivot mount, and the pivot link is elongate with opposite ends. A pivot arm is adapted for pivotally mounting on a first end of the tilt tube shaft. A second end of the pivot arm is adapted for pivotally mounting on the second end of pivot link. A location of the pivot arm between the first and second ends is adapted for pivotally mounting on the first end of the tilt tube shaft. A drag link connector is adapted for connecting to the primary drag link of the primary engine. A connector assembly is adapted for connecting the drag link connector to the pivot arm. The connector assembly comprises a connector bar having opposite ends and a releasable connector being located at each end of the connector bar.

23 Claims, 6 Drawing Sheets

FIG. 3
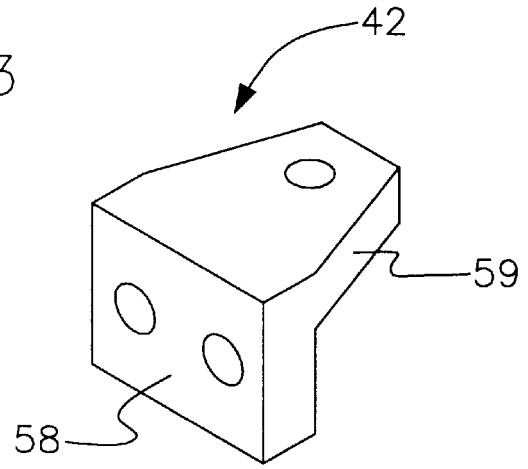
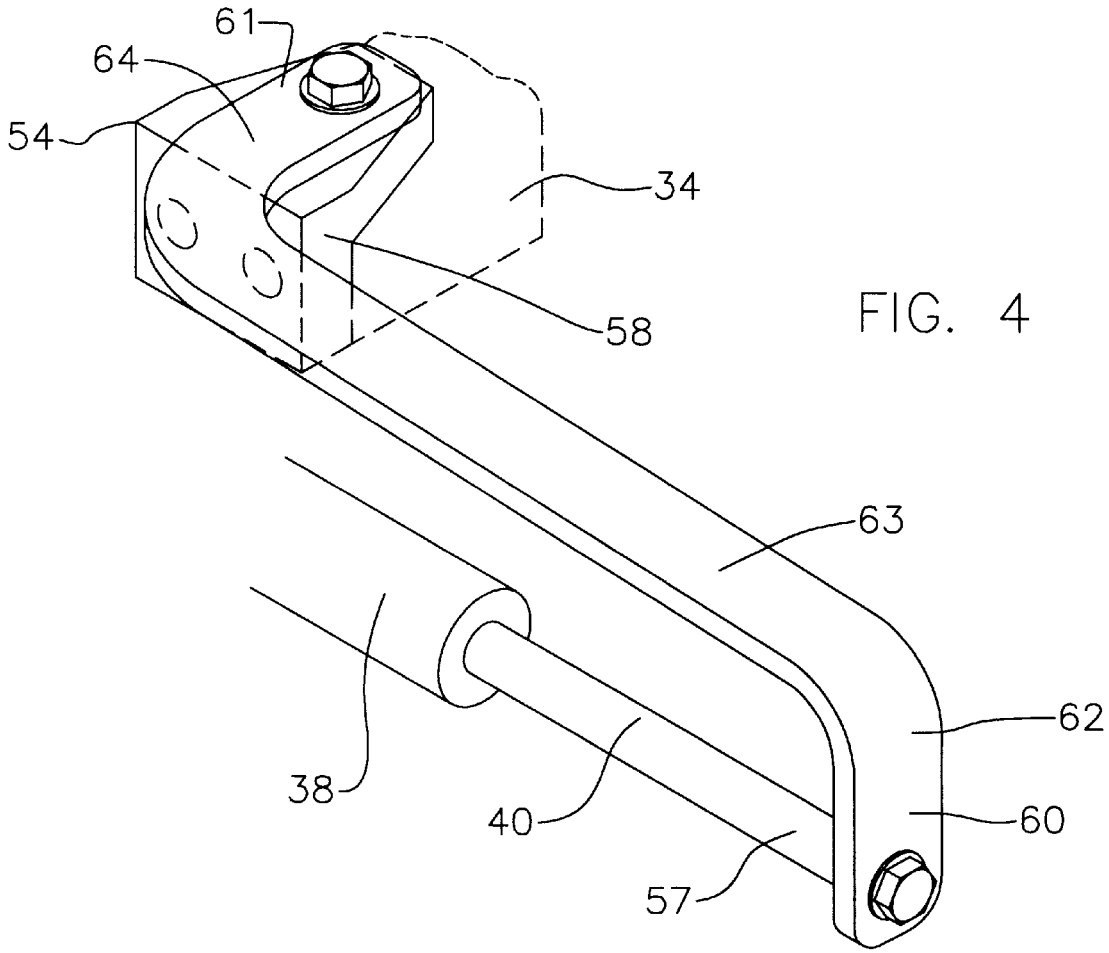
FIG. 4

STEERING SYSTEM FOR PLURAL MARINE PROPULSION ENGINES

BACKGROUND OF THE INVENTION

1. Field of the Invention

The present invention relates to boat steering systems and more particularly pertains to a new steering system for plural marine propulsion engines for steering primary and secondary marine propulsion engines using a single steering control.

2. Description of the Prior Art

Boats, and especially boats used for conducting the sport of fishing, often employ a pair of marine propulsion engines for propelling the boat. A primary one of the engines is typically employed for high speed cruising, and a secondary one of the engines is used for relatively slower travel, often referred to as "trolling". The engine used for trolling is usually smaller, and typically much smaller, than the primary engine. Boats are also typically equipped with a steering system that allows an operator of the boat to steer the direction of movement of the boat (i.e., by pivoting the primary engine with respect to the transom of the boat) from a relatively remote location toward the front of the boat. However, since most boats are not originally equipped with a secondary engine, the steering systems of most boats are only adapted for steering the primary engine, and the steering system is not readily capable of steering an added secondary engine. The secondary engine may be manually steered by the operator from a position adjacent to the transom, but this is inconvenient and is highly disliked.

Various secondary engine steering apparatus have been proposed for use when a secondary engine is added to the transom of a boat. Some of these apparatus are designed for mounting to the portions of the engines located outside the hull of the boat, and thus are more vulnerable to damage during use than if located inside the boat hull. Some of the proposed apparatus provide a direct link between the engines that attempt to pivot the primary and secondary engines equally, but the size difference between the engines typically means that the engines, or the steering portions of the engines, do not move equal distances. Apparatus that do not account for the relative difference in size of the engines and degree of movement of the engine during steering.

One significant obstacle to acceptable steering coordination is the common practice of tilting one of the primary or secondary engines out of an operational position and into a stored position when the other of the engines is being operated. Thus, it is desirable that the engine in the operational position remain steerable while the other engine is in the stored position, without interference with steering of the operating engine or binding or bending of the steering apparatus.

A further obstacle to coordinating the steering of the engines is encountered where the upper edge of the transom of the boat is not straight, but is "stepped" such that a central portion of the upper edge of the transom is oriented lower than end portions of the upper edge of the transom. The difference between the positions of the central and side portions of the upper edge of the transom may range from approximately 5 inches to approximately 20 inches of more, often depending on the particular manufacturer of the boat. This wide variation makes the steering of both engines using the primary steering system more difficult, and may require the use of different apparatus for straight and steeped transoms.

The steering system for plural marine propulsion engines according to the present invention substantially departs from the conventional concepts and designs of the prior art, and in so doing provides an apparatus primarily developed for the purpose of steering primary and secondary marine propulsion engines using a single steering control.

SUMMARY OF THE INVENTION

In view of the foregoing disadvantages inherent in the known types of boat steering systems now present in the prior art, the present invention provides a new steering system for plural marine propulsion engines construction wherein the same can be utilized for steering primary and secondary marine propulsion engines using a single steering control.

The general purpose of the present invention, which will be described subsequently in greater detail, is to provide a new steering system for plural marine propulsion engines apparatus and method which has many of the advantages of the boat steering systems mentioned heretofore and many novel features that result in a new steering system for plural marine propulsion engines which is not anticipated, rendered obvious, suggested, or even implied by any of the prior art boat steering systems, either alone or in any combination thereof.

To attain this, the present invention generally comprises a steering apparatus kit for steering a primary and secondary marine propulsion engines mounted on a transom of a boat. A suitable primary marine propulsion engine has a primary engine housing pivotally mounted on a primary transom mounting structure. The primary transom mounting structure includes a primary tilt tube and a primary steering shaft slidably mounted in the primary tilt tube. A primary drag link extends between the second end of the primary steering shaft and the primary engine housing. A suitable secondary marine propulsion engine has a secondary engine housing pivotally mounted on a secondary transom mounting structure which includes a secondary tilt tube. The steering apparatus kit of the invention includes a tilt tube shaft adapted for slidably mounting in the secondary tilt tube of the secondary marine propulsion engine, and the tilt tube shaft has a first end and a second end. A slave drag link is adapted for linking the second end of the tilt tube shaft to the secondary marine propulsion engine. A first end of the slave drag link is adapted for pivotally mounting on the tilt tube shaft. A second end of the slave drag link is adapted for pivotally mounting on the secondary marine propulsion engine. A pivot mount is adapted for mounting on the secondary tilt tube. A pivot link is adapted for pivotally mounting on the pivot mount, and the pivot link is elongate with opposite ends. A pivot arm is adapted for pivotally mounting on the first end of the tilt tube shaft. The pivot arm has a first end and a second end, with the second end of the pivot arm being adapted for pivotally mounting on the second end of pivot link. A location of the pivot arm between the first and second ends is adapted for pivotally mounting on the first end of the tilt tube shaft. A drag link connector is adapted for connecting to the primary drag link of the primary marine propulsion engine. A connector assembly is adapted for connecting the drag link connector to the pivot arm. The connector assembly comprises a connector bar having opposite ends and a releasable connector being located at each end of the connector bar. A first one of the releasable connectors is adapted for mounting a first end of the connector bar to the drag link connector, and a second one of the releasable connectors is adapted for mounting a second end of the connector bar to the first end of the pivot arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new steering system for plural marine propulsion engines apparatus and method which has many of the advantages of the boat steering systems mentioned heretofore and many novel features that result in a new steering system for plural marine propulsion engines which is not anticipated, rendered obvious, suggested, or even implied by any of the prior art boat steering systems, either alone or in any combination thereof.

It is another object of the present invention to provide a new steering system for plural marine propulsion engines which may be easily and efficiently manufactured and marketed.

It is a further object of the present invention to provide a new steering system for plural marine propulsion engines which is of a durable and reliable construction.

An even further object of the present invention is to provide a new steering system for plural marine propulsion engines which is susceptible of a low cost of manufacture with regard to both materials and labor, and which accordingly is then susceptible of low prices of sale to the consuming public, thereby making such steering system for plural marine propulsion engines economically available to the buying public.

Still yet another object of the present invention is to provide a new steering system for plural marine propulsion engines which provides in the apparatuses and methods of the prior art some of the advantages thereof, while simultaneously overcoming some of the disadvantages normally associated therewith.

Still another object of the present invention is to provide a new steering system for plural marine propulsion engines for steering primary and secondary marine propulsion engines using a single steering control.

Yet another object of the present invention is to provide a new steering system for plural marine propulsion engines which includes a steering apparatus kit for steering a primary and secondary marine propulsion engines mounted on a transom of a boat. A suitable primary marine propulsion engine has a primary engine housing pivotally mounted on a primary transom mounting structure. The primary transom mounting structure includes a primary tilt tube and a primary steering shaft slidably mounted in the primary tilt tube. A primary drag link extends between the second end of the primary steering shaft and the primary engine housing. A suitable secondary marine propulsion engine has a secondary engine housing pivotally mounted on a secondary transom mounting structure which includes a secondary tilt tube. The steering apparatus kit of the invention includes a tilt tube shaft adapted for slidably mounting in the secondary tilt tube of the secondary marine propulsion engine, and the tilt tube shaft has a first end and a second end. A slave drag link is adapted for linking the second end of the tilt tube shaft to the secondary marine propulsion engine. A first end of the slave drag link is adapted for pivotally mounting on the tilt tube shaft. A second end of the slave drag link is adapted for pivotally mounting on the secondary marine propulsion engine. A pivot mount is adapted for mounting on the secondary tilt tube. A pivot link is adapted for pivotally mounting on the pivot mount, and the pivot link is elongate with opposite ends. A pivot arm is adapted for pivotally mounting on the first end of the tilt tube shaft. The pivot arm has a first end and a second end, with the second end of the pivot arm being adapted for pivotally mounting on the second end of pivot link. A location of the pivot arm between the first and second ends is adapted for pivotally mounting on the first end of the tilt tube shaft. A drag link connector is adapted for connecting to the primary drag link of the primary marine propulsion engine. A connector assembly is adapted for connecting the drag link connector to the pivot arm. The connector assembly comprises a connector bar having opposite ends and a releasable connector being located at each end of the connector bar. A first one of the releasable connectors is adapted for mounting a first end of the connector bar to the drag link connector, and a second one of the releasable connectors is adapted for mounting a second end of the connector bar to the first end of the pivot arm.

Still yet another object of the present invention is to provide a new steering system for plural marine propulsion engines that steers the plural engines even when one of the engines is tilted into a stored, non-operational position.

Even still another object of the present invention is to provide a new steering system for plural marine propulsion engines that may be used on both straight and stepped boat transoms with minor adjustments of the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the secondary steering connector of the present invention.

FIG. 4 is a schematic perspective view of a portion of the linkage of the present invention located adjacent to the secondary marine propulsion engine.

DESCRIPTION OF THE PREFERRED EMBODIMENT

Figure 1:
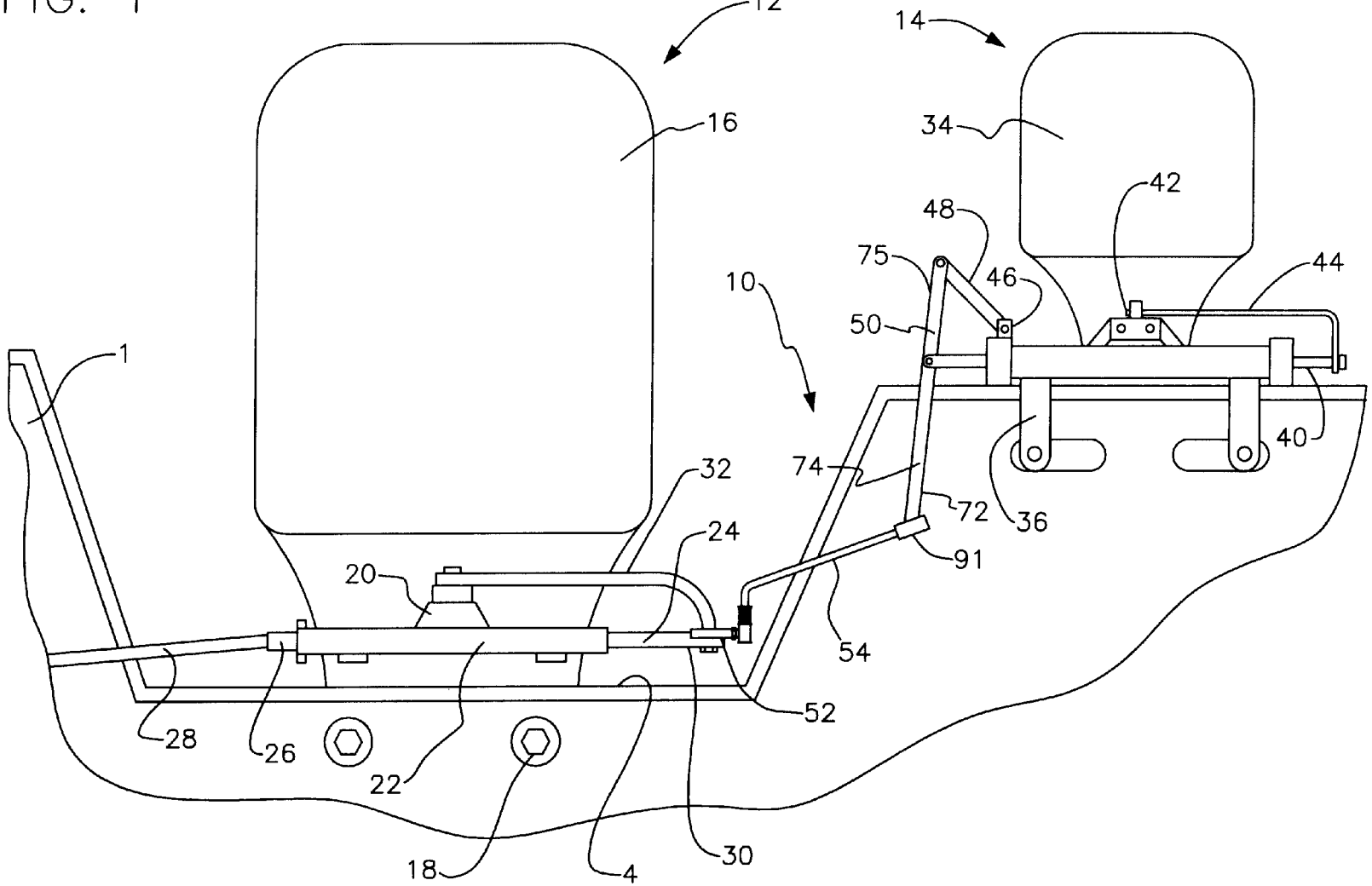
FIG. 1 is a schematic front view of a new steering system for plural marine propulsion engines according to the present invention, particularly illustrating the invention on a boat having a stepped transom.

With reference now to the drawings, and in particular to FIGS. 1 through 8 thereof, a new steering system for plural marine propulsion engines embodying the principles and concepts of the present invention will be described.

As best illustrated in FIGS. 1 through 8, the invention includes a kit comprised of components for forming a linkage 10 between plural marine propulsion engines for simultaneously steering the plural engines using a unified steering control system.

A suitable boat 1 for the practice of the invention includes a transom 2 at the rear of the boat, and the transom generally has an upper edge 4 or ledge on which outboard-type marine propulsion engines are mounted. The boat may have a stepped transom 2, or may have a straight transom 3.

A primary marine propulsion engine 12 is generally mounted at a central location on the transom 2, and a secondary marine propulsion engine 14 is located at a laterally outward location on the transom with respect to the primary engine. The primary and secondary marine propulsion engines are most preferably of the outboard type. The primary engine has a horsepower rating greater than the secondary engine. Illustratively, the secondary engine 14 may have a power rating of approximately 5 to 25 or more horsepower, and the primary engine may have a horsepower rating above at least approximately 25 horsepower.

The primary marine propulsion engine has a primary engine housing 16 that is pivotally mounted on a primary transom mounting structure 18 which is mounted on the transom adjacent to the upper edge. The primary engine housing has a primary steering connector 20 mounted on a front of the primary engine housing. The primary transom mounting structure includes a primary tilt tube 22 which is generally hollow and has an axis that is oriented generally parallel to the transom. A primary steering shaft 24 is slidably mounted in the primary tilt tube for permitting lateral movement of the shaft with respect to the tilt tube. The primary steering shaft has a first end 26 that is mounted to a steering cable 28 which is connected to a steering wheel (not shown) typically at a remote location toward the front of the boat. A second end 30 of the steering shaft 24 is located opposite of the first end, and a primary drag link 32 extends between the second end of the primary steering shaft and the primary steering connector 20 on the primary engine housing. Lateral movement of the steering shaft (produced by movement of the steering cable) is thus transmitted to the primary engine housing through the primary drag link, which effects a pivoting of the primary engine housing and a steering of the direction of movement of the boat.

The secondary marine propulsion engine 14 has a secondary engine housing 34 that is pivotally mounted on a secondary transom mounting structure 36 mounted on the transom adjacent to the upper edge. The secondary transom mounting structure includes a secondary tilt tube 38 that is substantially hollow and extends laterally and generally parallel to the transom.

A steering apparatus of the invention is provided for steering the primary and secondary marine propulsion engines mounted on the transom of the boat. The apparatus permits the engines to be steered in unison from the remotely mounted steering wheel or other steering control. Significantly, the parts of the apparatus may be provided as a kit that may be used to retrofit boats at the time when a secondary marine propulsion engine is installed to the transom, or at a time after installation of the secondary engine.

The steering apparatus generally comprises a tilt tube shaft 40, a secondary steering connector 42, a slave drag link 44, a pivot mount 46, a pivot link 48, a pivot arm 50, a drag link connector 52, and a connector assembly 54.

The tilt tube shaft 40 of the invention is adapted for slidably mounting in the secondary tilt tube 38 of the secondary transom mounting structure so that the tilt tube shaft is laterally movable with respect to the boat. The tilt tube shaft has a first end 56 and a second end 57. Preferably, the first end of the tilt tube shaft has an aperture that extends through the tilt tube shaft, and ideally the aperture extends in a direction perpendicular to a longitudinal axis of the tilt tube shaft. The second end of the tilt tube shaft preferably has a bore into the tilt tube shaft, and ideally the bore extends through an end face of the tilt tube shaft in the longitudinal direction of the shaft. The orientation of the bore in the second end permits the secondary engine housing and the secondary drag link to be tilted with respect to the tilt tube shaft without affecting the lateral slidability of the shaft. In one illustrative embodiment of the invention, the tilt tube shaft has a length of approximately 16 inches (approximately 40.5 cm).

The secondary steering connector 42 is adapted for mounting on the secondary engine housing 34 toward a front of the engine housing. A preferred secondary steering connector has a mounting portion 58 for mounting on the secondary engine housing, and an extension portion 59 that extends substantially perpendicular to the mounting portion. In one embodiment, the extension portion extends at an angle of approximately 8.0 degrees with respect to the mounting portion. Preferably, the mounting portion may have a pair of holes for permitting a fastener to pass through the mounting portion and into the secondary engine housing. The extension portion may have a hole for mounting the slave drag link 44 thereto with a fastener.

The slave drag link 44 of the invention is provided for linking the second end 57 of the tilt tube shaft 40 to the secondary steering connector 42 for converting the lateral movement of the tilt tube shaft into pivot movement of the secondary engine housing. A first end 60 of the slave drag link is pivotally mountable on the tilt tube shaft, and a second end 61 of the slave drag link is pivotally mountable on the secondary steering connector. Preferably, the slave drag link has a first end portion 62, a central portion 63, and a second end portion 64. The central portion defines a central axis. The first end portion 62 of the slave drag link may extend in a first direction oriented perpendicular to the central axis (and the central portion 63), and the second end portion 64 of the slave drag link may extend in a second direction oriented perpendicular to the central axis (and the central portion). The first direction is preferably oriented perpendicular to the second direction. When the elements of the linkage are mounted on a boat, the central axis of the slave drag link is preferably oriented generally parallel to the tilt tube shaft. In the illustrative embodiment, the first end portion has a length of approximately 2.5 inches (approximately 6.2 cm), the central portion has a length of approximately 8.5 inches (approximately 21.5 cm), and the second end portion has a length of approximately 3 inches (approximately 7.5 cm).

The pivot mount 46 is adapted for mounting on the secondary tilt tube 38. The pivot mount preferably comprises a tube engaging collar 66 having an opening for snugly receiving a portion of the secondary tilt tube 38 and fixedly mounting the pivot mount on the secondary tilt tube. The pivot mount has a first tab 67 extending from the tube engaging collar, and the first tab has a pivot aperture therein. Optionally, the pivot mount may have a second tab (not shown) extending from the tube engaging collar. In the illustrative embodiment, the opening in the tube engaging collar has a diameter of approximately ⅞ inch (approximately 2.25 cm), and the centers of the pivot aperture and the opening are approximately 1.4 inches (approximately 4 cm) apart.

The pivot link 48 is adapted to pivotally mount on the pivot mount. Preferably, the pivot link is elongate with opposite first 70 and second 71 ends. An aperture is located at each of the ends 70, 71 of the pivot link. The first end 70 of the pivot link is pivotally mounted on the first tab of the pivot mount, so that the pivot link may pivot with respect to the secondary tilt tube. In the illustrative embodiment, the distance between the apertures is approximately 3.5 inches (approximately 9 cm).

The pivot arm 50 is pivotally mounted on the first end 56 of the tilt tube shaft 40. The pivot arm has a first end 72 and a second end 73. The second end 73 of the pivot arm is pivotally mounted on the second end 71 of the pivot link so that the pivot arm may pivot with respect to the pivot link. A location of the pivot arm between the first and second ends is pivotally mounted on the first end of the tilt tube shaft so that the pivot arm may pivot with respect to the tilt tube shaft. The pivot location is preferably located relatively closer to the second end of the pivot arm than to the first end. The pivot arm preferably includes a first end hole located adjacent to the first end of the pivot arm, a second end hole located adjacent to the second end of the pivot arm, and a pivot hole located at the pivot location and between the first and second end holes. The end holes are especially useful for applications where the primary and secondary engines are mounted on stepped transoms. A second end fastener may extend through the second end hole and the aperture located in the second end 71 of the pivot link for effecting the pivotal connection therebetween. A pivot fastener may extend through the pivot hole and the aperture in the first end 56 of the tilt tube shaft for effecting the pivotal connection therebetween.

In the illustrative embodiment of the invention, the pivot arm is approximately 10.5 inches (approximately 26.5 cm) long. The pivot hole is located approximately 3.75 inches (approximately 9.5 cm) from the first end of the pivot arm. The first end hole is located approximately 3.5 inches (approximately 10 cm) from the pivot hole location. The second end hole is located approximately 6.5 inches (approximately 16.5 cm) from the pivot hole location.

Figure 2:
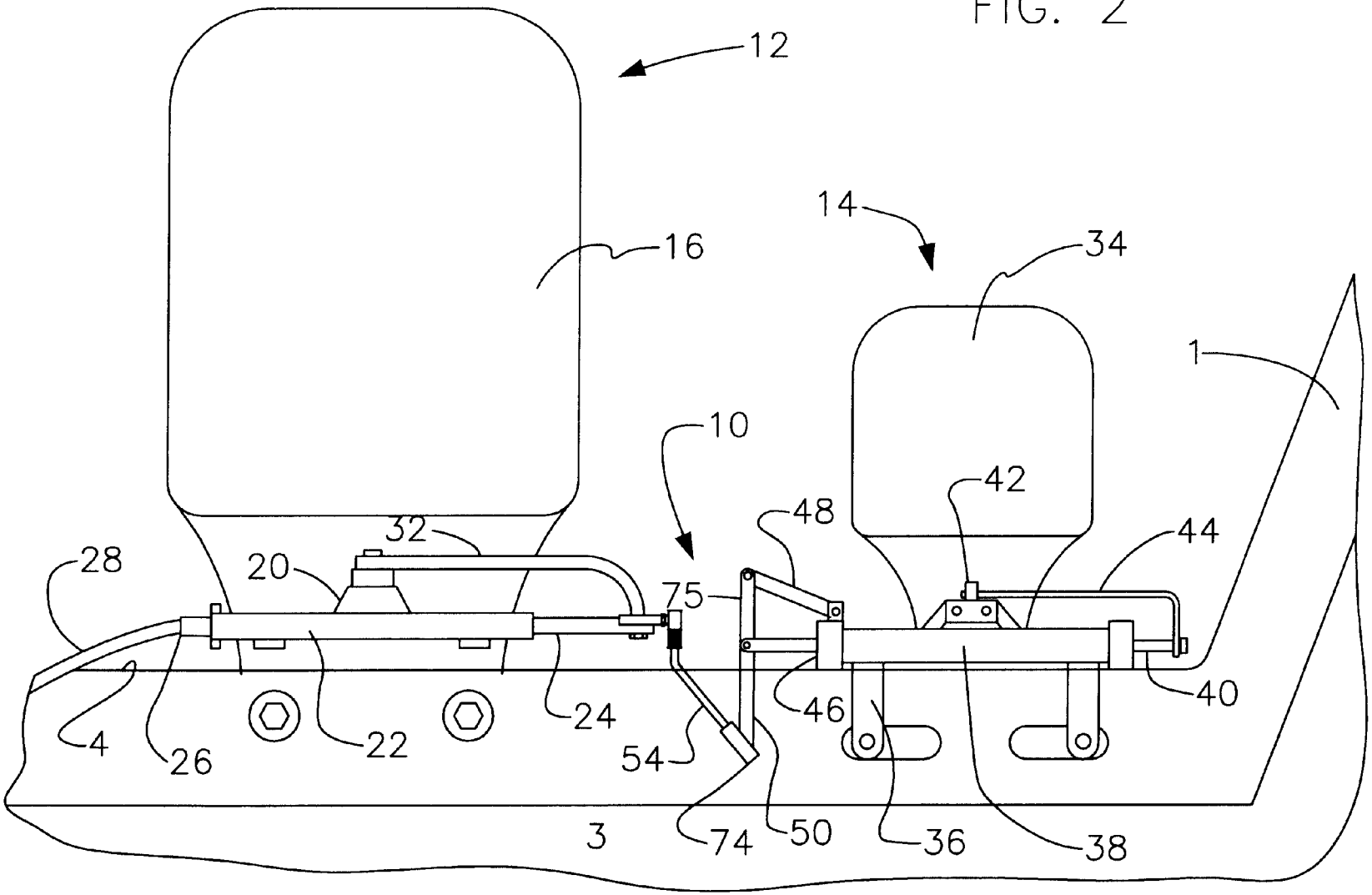
FIG. 2 is a schematic front view of the present invention particularly illustrating the invention on a boat having a straight transom.
Figure 5:
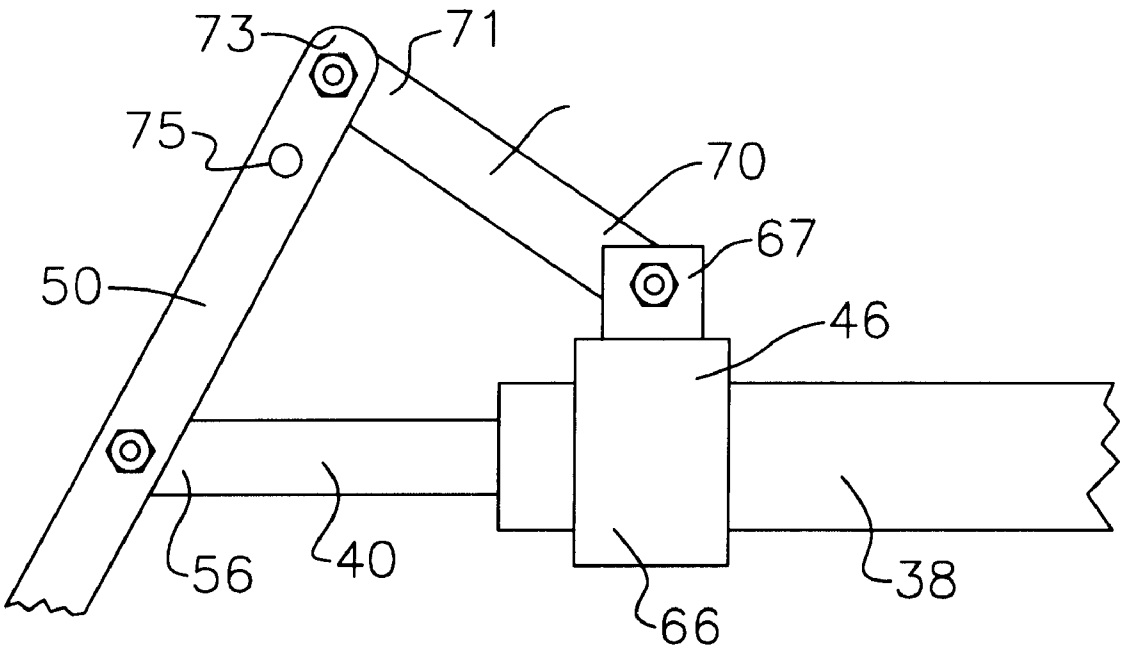
FIG. 5 is a schematic front view of a portion of the linkage of the present invention located adjacent to the secondary marine propulsion engine.
Figure 6:
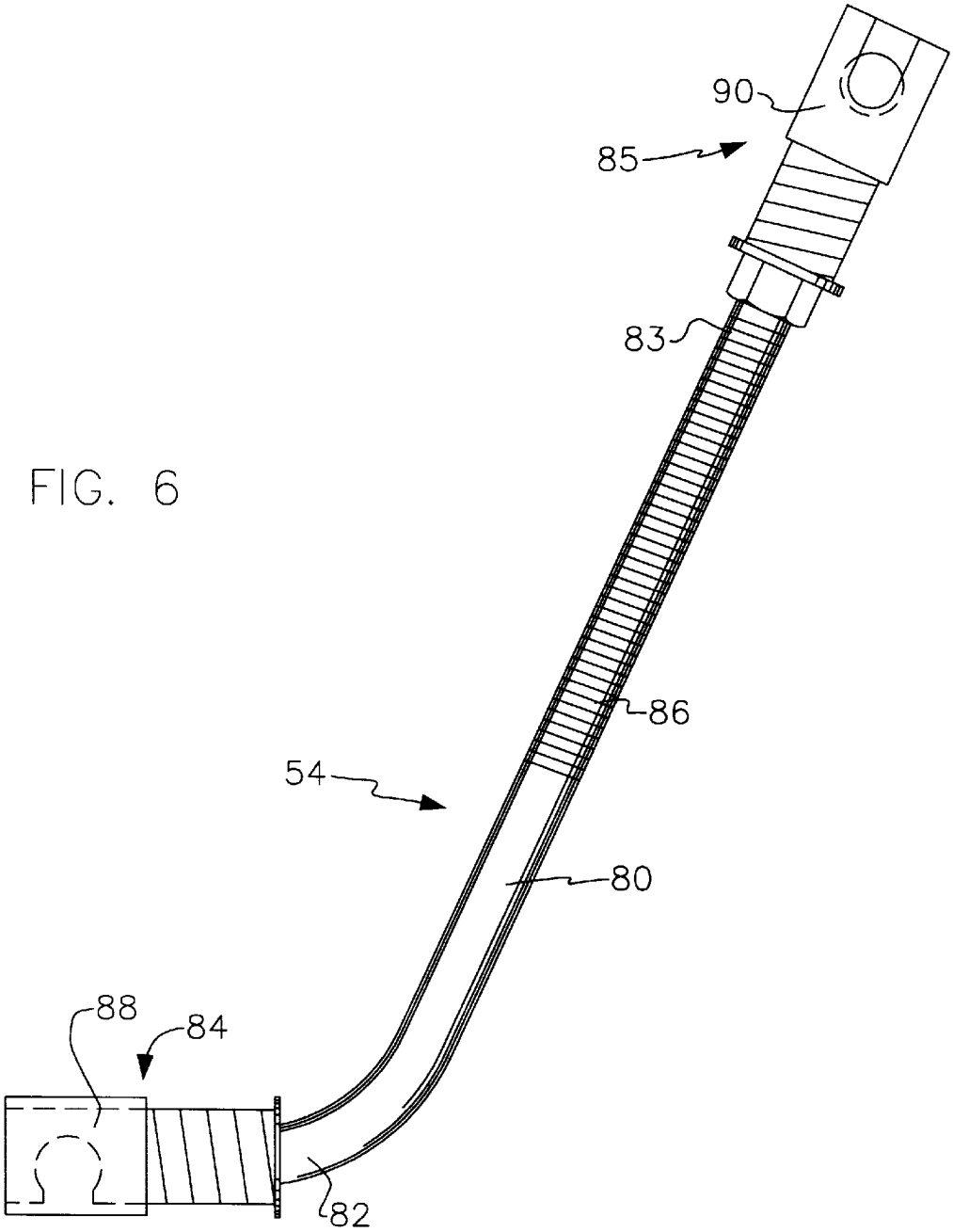
FIG. 6 is a schematic side view of the connector assembly of the present invention.
Figure 7:
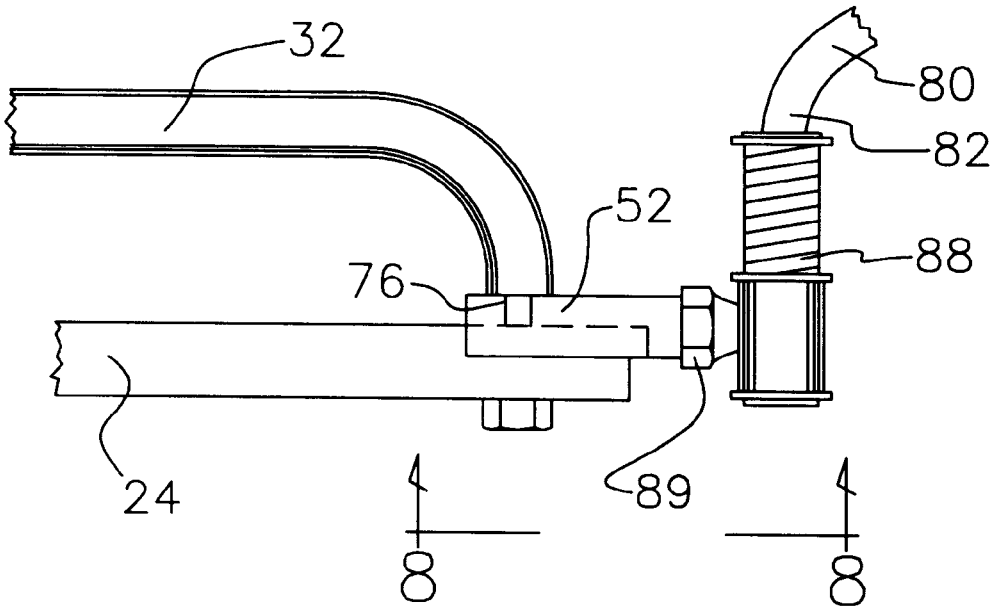
FIG. 7 is a schematic front view a portion of the linkage of the present invention particularly illustrating the mounting of the connector assembly and the drag link connector to the primary drag link and primary steering shaft of the primary marine propulsion engine.
Figure 8:
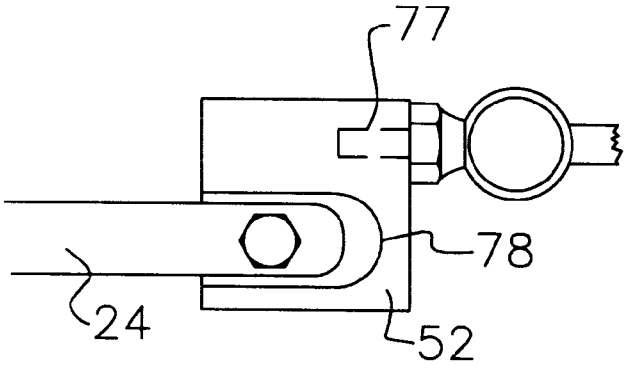
FIG. 8 is a schematic bottom view of the portion of the linkage shown in FIG. 7 taken along line 8-8 of FIG. 7.

Optionally, a pair of intermediate holes 74, 75 may be provided in the pivot arm 50 for providing an optional set of pivotal mounting points for the pivot link and the connector assembly 54 (see FIG. 1). These optional mounting points may be especially useful for applications where the primary and secondary engines are mounted on a straight transom 3. Significantly, each of the intermediate holes is spaced inwardly from one of the end holes, with each of the intermediate holes being located between the pivot hole and one of the end holes. Illustratively, FIG. 2 shows the use of the intermediate holes for mounting to the pivot link and the connector assembly, with end portions of the pivot arm beyond the intermediate holes optionally being removed from the pivot arm.

In the illustrative embodiment, the centers of the intermediate holes have approximately 7.5 inches (approximately 19 cm) therebetween, the intermediate hole adjacent the first end is located approximately 2.5 inches (approximately 6.3 cm) from the pivot hole location, and the intermediate hole adjacent the second end is located approximately 5 inches (approximately 12.7 cm) from the pivot hole location.

The drag link connector 52 is provided for connecting to the primary drag link 32 of the primary marine propulsion engine 12. The drag link connector has a drag link aperture 76 for receiving a portion of the primary drag link 32. A channel 77 extends into the drag link connector in a perpendicular relationship to the axis of the drag link aperture. A slot 78 is formed in one side of the drag link connector for seating a portion of the primary drag link of the primary engine. The drag link aperture extends into the slot. In the illustrative embodiment, the center of the first hole is approximately 0.5 inches (approximately 1.3 cm) from the center of the channel.

The connector assembly 54 is provided for connecting the drag link connector 52 to the pivot arm 50. The connector assembly comprises a connector bar 80 having opposite ends 82, 83. A connector 84, 85 is preferably located at each end of the connector bar. Preferably, the distance between the first connector 84 and the second connector 85 is adjustable. To provide the adjustability of the distance, a portion 86 of the connector bar adjacent to one of the ends may be threaded and one of the connectors is provided with a threaded bore such that amount of insertion of the end of the connector bar into the connector is adjustable. The distance between the first connector 84 of the first end 82 and the second connector 85 of the second end 83 is thus adjustable for adjusting the movement of the overall linkage for the particular installation.

Ideally, each of the connectors 84, 85 comprises a first component and a second component, with the first component being releasable from the second component. A first one 84 of the releasable connectors comprises a first component 88 mounted on the first end 82 of the connector bar and a second component 89 mounted on the drag link connector 52. A second one 85 of the releasable connectors comprises a first component 90 mounted on the second end 83 of the connector bar and a second component 91 mounted on the first end 72 of the pivot arm. In the illustrative embodiment, the first component 88, 90 comprises a cylindrical base member having a cavity adapted for receiving a ball portion of the second component 89, 91. A notched sleeve of the first component is slidably mounted on the base member, and is biased into a locked position by a spring. The notched sleeve may be moved into a release position with respect to the base member, and in the release position the ball portion of the second component may be inserted into the cavity. Movement of the notched sleeve back into the locked position traps or locks the ball portion in a swivelable mounting with the base member. One preferred releasable connector is available from Goldeneye Products, Inc. of Minneapolis, Minn.

In use, the elements of the invention are connected in the manner described to form a linkage between the primary drag link and the secondary engine housing. Significantly, the linkage permits the steering of both engines regardless of whether one or both of the engines are in the operational (lowered) position or in the tilted (raised) position, without binding or bending the elements or otherwise damaging the linkage. The linkage may be easily and quickly rendered inoperable by removing the connector bar from the linkage by releasing the releasable connectors, and the connector bar may be similarly easily and quickly replaced in the linkage. The travel of the secondary drag link is reduced from the travel of the primary drag link, which can eliminate potential interference of the secondary drag link with a side of the boat hull or engine compartment. In the illustrative embodiment, the primary steering shaft and drag link travel laterally a distance of approximately 8 inches, while the secondary tilt tube shaft and drag link travel laterally a distance of approximately 3 inches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A steering apparatus kit for steering a primary and secondary marine propulsion engines mounted on a transom of a boat, the primary marine propulsion engine having a primary engine housing pivotally mounted on a primary transom mounting structure, the primary transom mounting structure including a primary tilt tube, a primary steering shaft, the primary steering shaft being slidably mounted in the primary tilt tube, the primary steering shaft, a primary drag link extending between the second end of the primary steering shaft and the primary engine housing, a secondary marine propulsion engine having a secondary engine housing pivotally mounted on a secondary transom mounting structure, the secondary transom mounting structure including a secondary tilt tube, the steering apparatus kit comprising:

a tilt tube shaft adapted for slidably mounting in the secondary tilt tube of the secondary marine propulsion engine, the tilt tube shaft having a first end and a second end;

a slave drag link adapted for linking the second end of the tilt tube shaft to the secondary marine propulsion engine, a first end of the slave drag link being adapted for pivotally mounting on the tilt tube shaft, a second end of the slave drag link being adapted for pivotally mounting on the secondary marine propulsion engine;

a pivot mount adapted for mounting on the secondary tilt tube;

a pivot link adapted for pivotally mounting on the pivot mount, the pivot link being elongate with opposite ends;

a pivot arm adapted for pivotally mounting on the first end of the tilt tube shaft, the pivot arm having a first end and a second end, the second end of the pivot arm being adapted for pivotally mounting on the second end of pivot link, a location of the pivot arm between the first and second ends being adapted for pivotally mounting on the first end of the tilt tube shaft;

a drag link connector adapted for connecting to the primary drag link of the primary marine propulsion engine; and a connector assembly being adapted for connecting the drag link connector to the pivot arm, the connector assembly comprising a connector bar having opposite ends and a releasable connector being located at each end of the connector bar, a first one of the releasable connectors being adapted for mounting a first end of the connector bar to the drag link connector, a second one of the releasable connectors being adapted for mounting a second end of the connector bar to the first end of the pivot arm.

2. The steering apparatus kit of claim 1 wherein the first end of the tilt tube shaft has an aperture extending through the first end, the aperture extending in a direction perpendicular to a longitudinal axis of the tilt tube shaft.

3. The steering apparatus kit of claim 1 wherein the second end of the tilt tube shaft having a bore therein, the bore extending in the longitudinal direction of the tilt tube shaft.

4. The steering apparatus kit of claim 1 additionally comprising a secondary steering connector adapted for mounting on the secondary marine propulsion engine housing and for mounting to the slave drag link.

5. The steering apparatus kit of claim 1 wherein the slave drag link has a first end portion, a central portion, and a second end portion, the central portion defining a central axis, the first end portion of the slave drag link extending in a first direction oriented perpendicular to the central axis, the second end portion of the slave drag link extending in a second direction oriented perpendicular to the central axis, the first direction being oriented perpendicular to the second direction.

6. The steering apparatus kit of claim 1 wherein the pivot mount comprises a tube engaging collar having an opening for receiving a portion of the secondary tilt tube and fixing the pivot mount on the secondary tilt tube.

7. The steering apparatus kit of claim 6 wherein the pivot mount has a first tab extending from the tube engaging collar, the first tab having the pivot aperture therein.

8. The steering apparatus kit of claim 1 wherein an aperture is located at each of the ends of the pivot link, the first end of the pivot link being adapted for pivotally mounting on the pivot mount.

9. The steering apparatus kit of claim 1 wherein the pivot arm includes a first end hole, a second end hole, and a pivot hole, the second end hole receiving a second end fastener for pivotally connecting the pivot arm to the second end of the pivot link, the pivot hole receiving a medial fastener for pivotally connecting the pivot arm to the tilt tube shaft.

10. The steering apparatus kit of claim 9 wherein a pair of intermediate holes are formed in the pivot arm, each of the intermediate holes being spaced inward from one of the end holes.

11. The steering apparatus kit of claim 1 wherein the drag link connector has a drag link aperture adapted for receiving a portion of the primary drag link passes.

12. The steering apparatus kit of claim 1 wherein each of the releasable connectors comprises a first component and a second component, a first one of the releasable connectors comprising a first component mounted on the first end of the connector bar and a second component mounted on the drag link connector, a second one of the releasable connectors comprising a first component mounted on a second end of the connector bar and a second component mounted on the first end of the pivot arm.

13. The steering apparatus kit of claim 1 wherein a distance between the releasable connectors located on the opposite ends of the connector bar is adjustable.

14. The steering apparatus kit of claim 13 wherein a portion of the connector bar adjacent to one of the ends is threaded and one of the first components has a threaded bore such that a degree of insertion of the end of the connector bar into the first component is adjustable.

15. A steering apparatus for steering a primary and secondary marine propulsion engines mounted on a transom of a boat, the primary marine propulsion engine having a primary engine housing pivotally mounted on a primary transom mounting structure, the primary transom mounting structure including a primary tilt tube, a primary steering shaft, the primary steering shaft being slidably mounted in the primary tilt tube, the primary steering shaft, a primary drag link extending between the second end of the primary steering shaft and the primary engine housing, a secondary marine propulsion engine having a secondary engine housing pivotally mounted on a secondary transom mounting structure, the secondary transom mounting structure including a secondary tilt tube, the steering apparatus kit comprising:

a tilt tube shaft adapted for slidably mounting in the secondary tilt tube of the secondary marine propulsion engine, the tilt tube shaft having a first end and a second end;

a slave drag link for linking the second end of the tilt tube shaft to the secondary marine propulsion engine, a first end of the slave drag link being pivotally mounted on the tilt tube shaft, a second end of the slave drag link being adapted for pivotally mounting on the secondary marine propulsion engine;

a pivot mount adapted for mounting on the secondary tilt tube of the secondary transom mounting structure;

a pivot link pivotally mounted on the pivot mount, the pivot link being elongate with opposite ends;

a pivot arm pivotally mounted on the first end of the tilt tube shaft, the pivot arm having a first end and a second end, the second end of the pivot arm being pivotally mounted on the second end of pivot link, a location of the pivot arm between the first and second ends being pivotally mounted on the first end of the tilt tube shaft;

a drag link connector adapted for connecting to the primary drag link of the primary marine propulsion engine; and a connector assembly connecting the drag link connector to the pivot arm, the connector assembly comprising a connector bar having opposite ends and a releasable connector being located at each end of the connector bar, a first one of the releasable connectors mounting a first end of the connector bar to the drag link connector, a second one of the releasable connectors mounting a second end of the connector bar to the first end of the pivot arm.

16. The steering apparatus of claim 15 additionally comprising a secondary steering connector adapted for mounting on the secondary marine propulsion engine housing, the secondary steering connector being mounted on the slave drag link.

17. The steering apparatus of claim 15 wherein the slave drag link has a first end portion, a central portion, and a second end portion, the central portion defining a central axis, the first end portion of the slave drag link extending in a first direction oriented perpendicular to the central axis, the second end portion of the slave drag link extending in a second direction oriented perpendicular to the central axis, the first direction being oriented perpendicular to the second direction.

18. The steering apparatus of claim 15 wherein the pivot mount comprises a tube engaging collar having an opening for receiving a portion of the secondary tilt tube and fixing the pivot mount on the secondary tilt tube.

19. The steering apparatus of claim 15 wherein the pivot arm includes a first end hole, a second end hole, and a pivot hole located between the first end hole and the second end hole, the second end hole receiving a second end fastener pivotally connecting the pivot arm to the second end of the pivot link, the pivot hole receiving a medial fastener pivotally connecting the pivot arm to the tilt tube shaft.

20. The steering apparatus of claim 19 wherein a pair of intermediate holes are formed in the pivot arm, each of the intermediate holes being spaced inward from one of the end holes.

21. The steering apparatus of claim 1 wherein a distance between the releasable connectors located on the opposite ends of the connector bar is adjustable.

22. The steering apparatus of claim 21 wherein a portion of the connector bar adjacent to one of the ends is threaded and one of the first components has a threaded bore such that a degree of insertion of the end of the connector bar into the first component is adjustable.

23. A system for propelling a boat having a transom with an upper edge, comprising:

a primary marine propulsion engine having a primary engine housing pivotally mounted on a primary transom mounting structure, the primary engine housing having a primary steering connector mounted on a front of the primary engine housing, the primary transom mounting structure including a primary tilt tube, and a primary steering shaft, the primary steering shaft being slidably mounted in the primary tilt tube, the primary steering shaft having a first end mounted to a steering cable in communication with a steering wheel and a second end opposite the first end, a primary drag link extending between the second end of the primary steering shaft and the primary steering connector;

a secondary marine propulsion engine having a secondary engine housing pivotally mounted on a secondary transom mounting structure, the secondary transom mounting structure including a secondary tilt tube;

a steering apparatus for steering the primary and secondary marine propulsion engines mounted on the transom of the boat, the steering apparatus comprising:

a tilt tube shaft slidably mounted in the secondary tilt tube, the tilt tube shaft having a first end and a second end, the first end of the tilt tube shaft having an aperture extending through the first end, the aperture extending in a direction perpendicular to a longitudinal axis of the tilt tube shaft, the second end of the tilt tube shaft having a bore therein, the bore extending in the longitudinal direction of the tilt tube shaft;

a secondary steering connector mounted on the secondary housing, the secondary steering connector having a mounting portion mounted on the secondary engine housing, the secondary steering arm connector having a extension portion extending perpendicularly to the mounting portion;

a slave drag link linking the second end of the tilt tube shaft to the secondary steering connector, a first end of the slave drag link being pivotally mounted on the tilt tube shaft, a second end of the slave drag link being pivotally mounted on the secondary steering connector, the slave drag link having a first end portion, a central portion, and a second end portion, the central portion defining a central axis, the first end portion of the slave drag link extending in a first direction oriented perpendicular to the central axis, the second end portion of the slave drag link extending in a second direction oriented perpendicular to the central axis, the first direction being oriented perpendicular to the second direction, the central axis of the slave drag link being oriented generally parallel to the tilt tube shaft;

a pivot mount mounted on the secondary tilt tube, the pivot mount having a pivot aperture, the pivot mount comprising a tube engaging collar having an opening receiving the secondary tilt tube and fixing the pivot mount on the secondary tilt tube, the pivot mount having a first tab extending from the tube engaging collar, the first tab having the pivot aperture therein, the pivot mount having a second tab extending from the tube engaging collar, a pivot link pivotally mounted on the pivot mount, the pivot link being elongate with opposite ends, an aperture being located at each of the ends of the pivot link, the first end of the pivot link being pivotally mounted on the first tab of the pivot mount, a pivot arm pivotally mounted on the first end of the tilt tube shaft, the pivot arm having a first end and a second end, the second end of the pivot arm being pivotally mounted on the second end of pivot link, a medial location of the pivot arm being pivotally mounted on the first end of the tilt tube shaft, the pivot arm including a first end hole, a second end hole, and a pivot hole, the second end hole receiving a second end fastener pivotally connecting the pivot arm to the second end of the pivot link, the pivot hole receiving a fastener pivotally connecting the pivot arm to the tilt tube shaft, a pair of intermediate holes, each of the intermediate holes being spaced inward from one of the end holes;

a drag link connector for connecting to the primary drag link of the primary marine propulsion engine, the drag link connector having a drag link aperture through which a portion of the primary drag link passes; and a connector assembly for connecting the drag link connector to the pivot arm, the connector assembly comprising a connector bar having opposite ends, a releasable connector being located at each end of the connector bar, each of the releasable connectors comprising a first component and a second component, a first one of the releasable connectors comprising a first component mounted on a first one of the ends of the connector bar and a second component mounted on the drag link connector, a second one of the releasable connectors comprising a first component mounted on a second one of the ends of the connector bar and a second component mounted on the first end of the pivot arm, a distance between the first component of the first end and the first component of the second end being adjustable, a portion of the connector bar adjacent to one of the ends being threaded and one of the first components having a threaded bore such that insertion of the end of the connector bar into the first component is adjustable.

* * * * *